US005662299A

United States Patent [19]

Mejia

[11] Patent Number: 5,662,299

[45] Date of Patent: Sep. 2, 1997

[54] WET PAINTBRUSH KEEPER AND CUTTING BUCKET

[76] Inventor: Jose Roberto Mejia, 14328 Kittridge St., Van Nuys, Calif. 91405

[21] Appl. No.: 498,566

[22] Filed: Jul. 6, 1995

[51] Int. Cl.[6] ..... A47K 1/00

[52] U.S. Cl. ..... 248/213.2; 248/113; 248/301; 248/311.2

[58] Field of Search ..... 248/213.2, 301, 248/311.2, 113

[56] References Cited

U.S. PATENT DOCUMENTS

| | | | |
|---|---|---|---|
| 1,551,243 | 8/1925 | Dick | 248/311.2 X |
| 1,865,283 | 6/1932 | Sohnle | 248/113 X |
| 1,963,434 | 6/1934 | Bruns | 248/133 X |
| 2,399,056 | 4/1946 | Oller | 248/113 X |
| 2,807,431 | 9/1957 | McHale | 248/113 |
| 3,182,943 | 5/1965 | Grossman | 248/311.2 X |
| 3,462,109 | 8/1969 | Forbes | 248/311.2 X |
| 3,980,264 | 9/1976 | Tomasik | 248/311.2 X |
| 4,749,112 | 6/1988 | Harper | 248/311.2 X |
| 5,148,755 | 9/1992 | Morales | 248/311.2 X |
| 5,419,154 | 5/1995 | Christoff | 248/311.2 X |

*Primary Examiner*—Leslie A. Braun
*Assistant Examiner*—Anita M. King
*Attorney, Agent, or Firm*—Allan M. Shapiro

[57] ABSTRACT

The cutting bucket is sized to receive the bristle end of a convenient cutting paintbrush, such as a 3 inch brush, and to hold a reasonable amount of paint, such as one quart. The cutting bucket has an exterior handle for convenient carrying. A bracket mounts on a large paint pail and detachably attaches the cutting bucket. A paintbrush holder is sized to detachably grasp the handle of the paintbrush. The paintbrush holder is on the bracket. The paintbrush is thus held above the bottom of the cutting bucket during non-use and can be detached with the cutting bucket for use.

2 Claims, 2 Drawing Sheets

FIG. 1
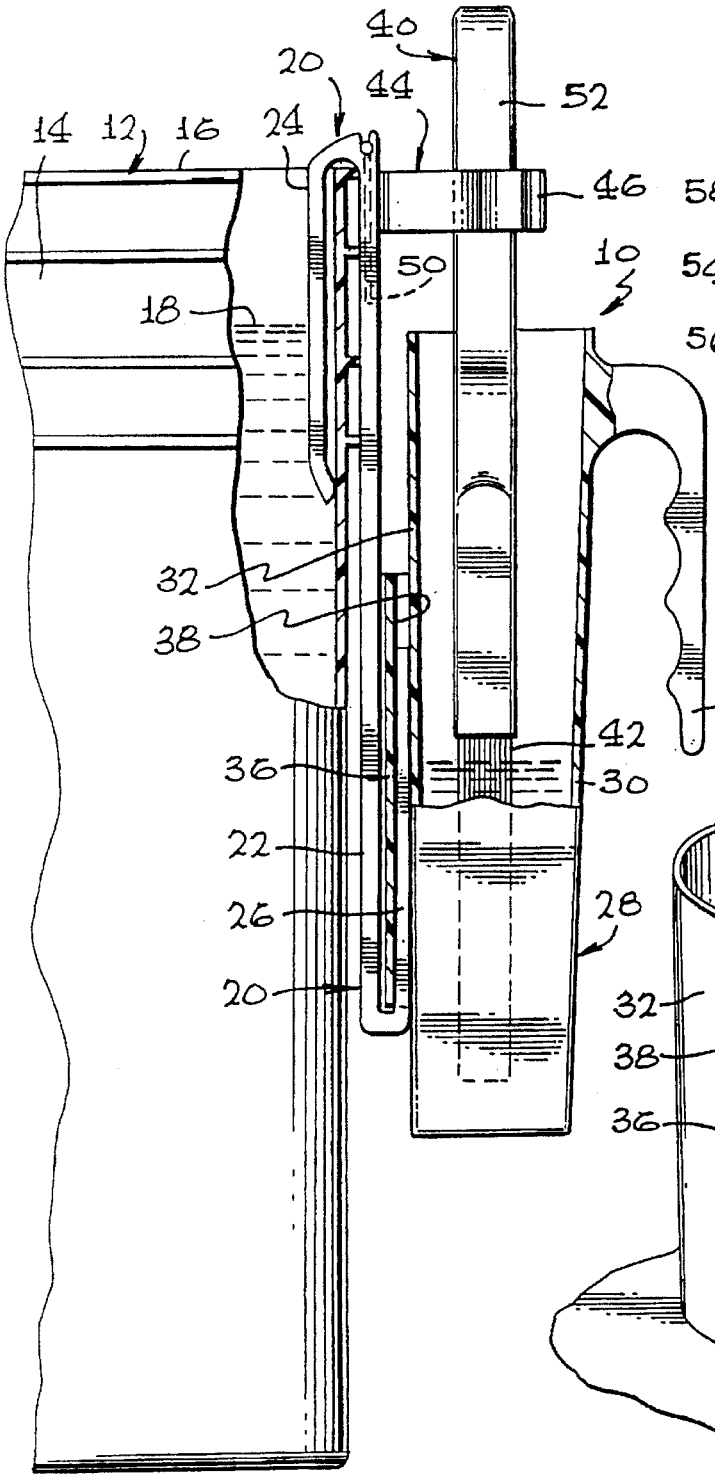
FIG. 3
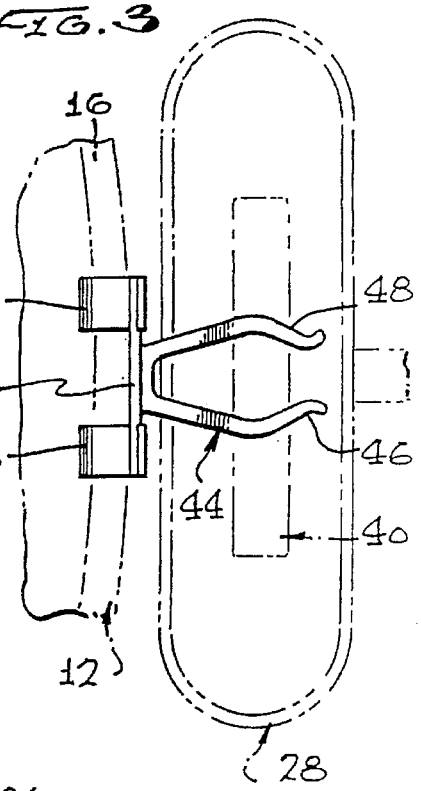
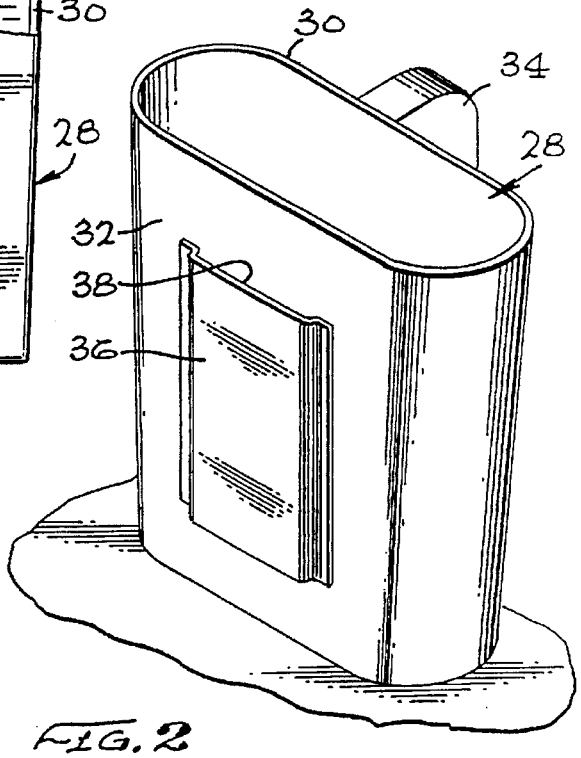
FIG. 2

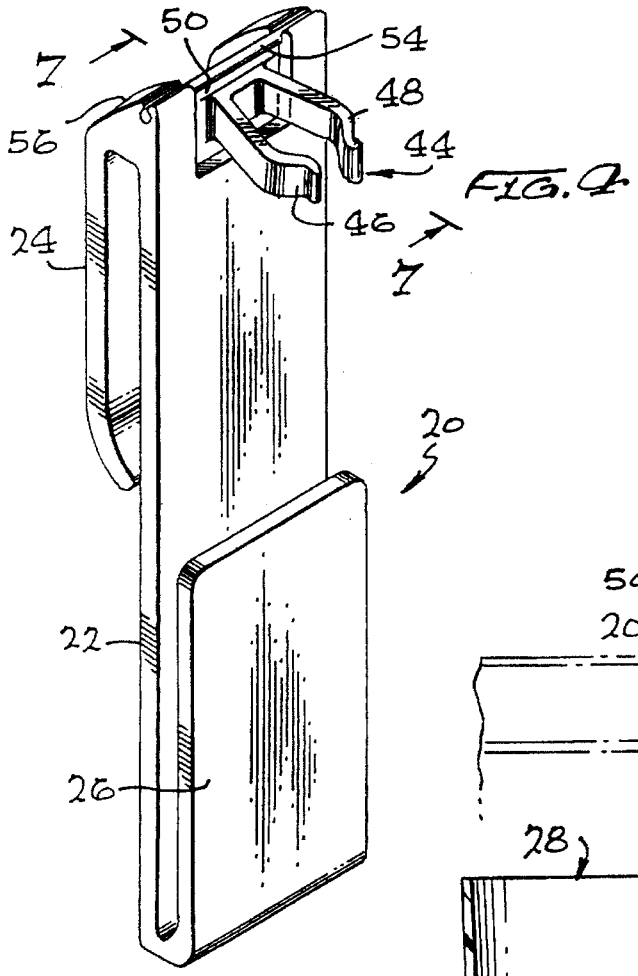
FIG. 4
FIG. 5
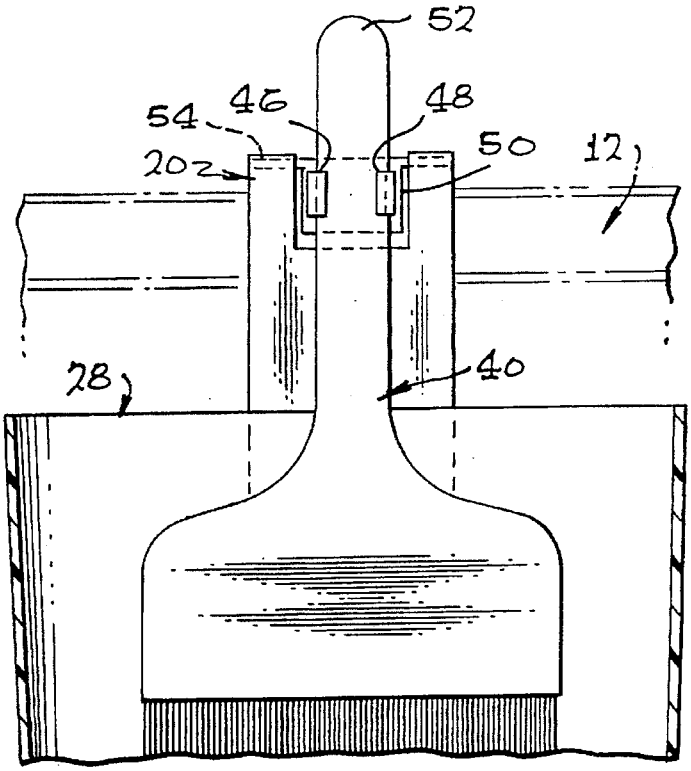
FIG. 6
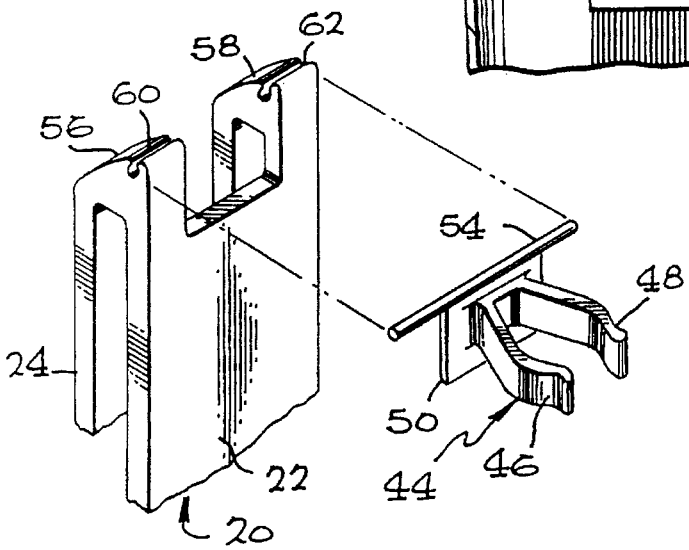
FIG. 7
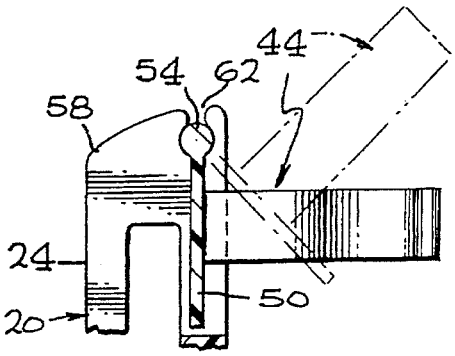

WET PAINTBRUSH KEEPER AND CUTTING BUCKET

FIELD OF THE INVENTION

This invention is directed to a cutting bucket having a bracket for detachably mounting the cutting bucket on a paint pail. The bracket also has a paintbrush holder for holding the paintbrush off of its bristles during non-use.

BACKGROUND OF THE INVENTION

When painting interiors, professional painters often use a 5-gallon paint pail in which the paint is supplied. A roller screen is attached over the edge of the paint pail into the interior. The painter primarily paints with a paint roller. A paint roller is dipped into the pail and rolled out on the screen to control the amount of paint on the paint roller. The painter then applies the roller to the wall and/or ceiling surface and rolls the paint thereon.

One of the problems which results from painting with a roller is the fact that the roller cannot reach the corners. To paint the corners, the painter uses a cutting brush, which is often a 2- or 3-inch wide paintbrush. The painter carries a smaller paint vessel, often called a cutting bucket, to hold about a quart of paint. He uses this brush and bucket to apply paint in the corners where the roller will not reach.

Problems arise when the painter wants to put down the cutting bucket and cutting brush when he is working with the roller. If the brush is left standing on its bristles in the cutting bucket, the bristles will get bent. If the brush is left lying out while roller-painting, the bristles will dry out. If the painter wants to move his equipment to the next painting site, such as an adjoining room, the separate pail, bucket and brush require special handling. Accordingly, there is need for a satisfactory solution to these problems.

SUMMARY OF THE INVENTION

In order to aid in the understanding of this invention, it can be stated in essentially summary form that it is directed to a cutting bucket which has associated therewith a bracket by which the cutting bucket is detachably attached to a paint pail. The bracket carries a paintbrush holder which holds the paintbrush in an upright position with its bristles in the paint in the cutting bucket during non-use.

It is thus an object and advantage of this invention to provide a wet paintbrush keeper which holds the paintbrush in the paint, but off of its bristle tips during non-use to protect the paintbrush, so as to keep the paintbrush in an available condition and position.

It is another object and advantage of this invention to provide a cutting bucket which is detachably attached to the large paint pail, but which can be lifted off so the painter can carry the bucket with him while he is performing the cutting operation.

It is another object and advantage of this invention to provide a wet paintbrush keeper and cutting bucket which can be detachably mounted on a large paint pail which is in use in connection with rolling paint so that the cutting bucket and associated paintbrush are conveniently available.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a side-elevational view of the wet paintbrush keeper and cutting bucket of this invention, mounted on a paint pail, with parts broken away and parts taken in section.

FIG. 2 is an isometric view of the cutting bucket.

FIG. 3 is a top plan view of the bracket which detachably attaches the cutting bucket to the paint pail and also carries a paintbrush holder thereon, with the pail and bucket indicated in phantom.

FIG. 4 is an isometric view of the bracket and paintbrush holder

FIG. 5 is an elevational view showing a paintbrush held in its holder and with parts of the cutting bucket broken away and parts taken in section.

FIG. 6 is an exploded perspective view of the paintbrush holder and the top portion of the bracket, with the lower portion broken away.

FIG. 7 is a side-elevational view of the paintbrush holder and the upper portion of the bracket, with parts broken away and parts taken in section.

DESCRIPTION OF THE PREFERRED EMBODIMENTS

The wet paintbrush keeper and cutting bucket of this invention is generally indicated at 10 in FIG. 1. It is designed to be used in association with a paint pail 12, also seen in FIG. 1. The illustrated paint pail is indicated to be a commercial five gallon pail. It has a side wall 14 which terminates in an upper rim 16. The pail 12 contains paint 18 which can be applied by using a paint roller or the like.

Keeper 10 includes a bracket 20 which is seen in full in FIGS. 1 and 4. The bracket 20 has a center panel 22 which is configured to lie outside of the paint pail 12, see FIG. 1. The center panel 22 has an upper hook 24 which is sized to fit over the upper rim 16 of the paint pail for detachably mounting the bracket 20 on the paint pail 12. The upper hook 24 and center panel 22 are sufficiently wide so that the center panel 22 lies against the outside of the paint pail and does not have an opportunity to twist.

Lower hook 26 also forms part of the bracket 20. Lower hook 26 extends upward from the bottom of panel 22 on the opposite side from upper hook 24. The purpose of the lower hook is to detachably attach the cutting bucket 28. As is seen in FIG. 2, the walls of the cutting bucket define a bucket 28 which is wider than it is thick. The front wall 30 and back wall 32 are substantially planar and substantially parallel to each other (except for molding draft). The front and back walls are joined by rounded ends to form a closed-bottom, open-top bucket. A handle 34 is provided for handling convenience. The cutting bucket is preferably about one quart in volume and sized to receive a 4-inch flat paintbrush, although it will usually be used with a somewhat smaller brush such as, for example, a 2-inch or 3-inch brush. Panel 36 is formed on or attached to the back 32 of cutting bucket 28. The panel 36 defines a slot 38 which is designed to slidably receive lower hook 26, as seen in FIG. 1. Thus, the bracket 20 can be hooked over the rim 16 of the paint pail 12, and the cutting bucket 28 can be hooked onto the lower hook 26 to support the cutting bucket. The handle 34 is conveniently positioned on the outside away from the bracket for easy manual engagement.

If the paintbrush 40 is left out, its bristles 42 will dry out. If it is left standing in the paint in the cutting bucket, the tips of the bristles 42 will rest on the bottom of the cutting bucket, with the weight of the brush thereon. The weight of the brush distorts the tips of the bristles. To overcome this problem, paintbrush holder 44 is provided. The paintbrush holder 44 is mounted adjacent the top of bracket 20, as seen in FIGS. 1 and 3–7. The paintbrush holder has left and right fingers 46 and 48, which are mounted on base 50. The fingers are resilient so that the handle 52 of paintbrush 40 can be snapped between the fingers and grasped therebetween to hold the paintbrush in an upright position. By snapping the paintbrush handle into the grasp of the fingers, the paintbrush handle is releasibly held at the desired height to keep the tips of the bristles from resting on the bottom of the cutting bucket.

In the preferred embodiment, it is preferable that the paintbrush holder 44 be able to swing out of the way when not in use. To accomplish this, the base 50 is mounted on pivot pin 54. The center panel 22 is bifurcated at its upper end, above the corresponding portion of the upper hook 24. This leaves left and right arms 56 and 58. The space between these arms is larger than the width of the panel 50. The arms have pivot bores 60 and 62 therein which are sized to receive the pivot pin 54. The bores 60 and 62 are open at the top so that, when the material is resilient, the pivot pin 54 can be snapped into position. Once in position, the paintbrush holder 44 can rotate upward about the axis of the pivot pin past the dashed line position shown in FIG. 7. This permits the paintbrush holder to be moved out of the way, as when lifting the cutting bucket off the bracket.

In use, there is paint in the pail and in the bucket. The cutting brush 40 hangs into the cutting bucket with its bristles 42 in the paint therein. This prevents the cutting brush bristles from drying out and keeps the brush ready for painting use. When the painter wants to cut in, he snaps the paintbrush out of its paintbrush holder 44 and, at the same time, grasps handle 34 and lifts the cutting bucket off of its lower hook 26. Now, the cutting bucket and paintbrush are free of the paint pail and are ready for separate use away from the pail. The painter does his cutting with the paint in the cutting bucket. When done with cutting, the painter wants to get back to rolling the paint onto the larger surfaces. Rolling is more desirable because it is faster and does not take as much time or skill to achieve an even paint coat. The painter returns the cutting bucket to the paint pail and hooks its panel 36 over the lower hook 26. The paintbrush holder 44 is rotated downwardly into position. The paintbrush is held in place by snapping the paintbrush handle into the paintbrush holder. The structure is thus convenient to the painter because his cutting brush and cutting bucket are always convenient to the area being painted because the painter carries his cutting brush and cutting bucket with his paint pail.

The cutting bucket is specially shaped so that it contains only enough paint for a reasonable amount of cutting so that a large quantity of paint need not be carried around. Aside from the volume consideration of the cutting bucket, it could be made in other shapes.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. The combination of a wet paintbrush keeper and a cutting bucket comprising:

said keeper having a bracket, said bracket having detachable mounting means thereon for detachable mounting on a paint pail, said bracket having detachable attachment means thereon for detachable attachment of said cutting bucket thereto, said cutting bucket being configured to attach to said bracket by said detachable attachment means, said cutting bucket having side walls and a bottom and having an open top so that paint may be held therein;

a paintbrush holder on said bracket, said paintbrush holder comprising first and second fingers positioned with respect to each other and positioned on said bracket above said cutting bucket when said cutting bucket is attached to said attachment means so as to be able to grasp the handle of a paintbrush and hold the paintbrush with its bristles above said bottom of said cutting bucket, said fingers being resilient with respect to each other so that a paintbrush handle may be inserted therebetween by resilient deflection of at least one of said fingers and the paintbrush handle is retained by force thereon by deflection of at least one of said resilient fingers;

said bracket being bifurcated to define left and right arms, said paintbrush holder being positioned at least partly between said left and right arms and including a pivot pin engaging said arms and said fingers so that said fingers can be pivoted with respect to said bracket away from a position above said cutting bucket.

2. The combination of a wet paintbrush keeper and a cutting bucket comprising:

said bucket having walls and a bottom to define a paint-retaining bucket having an open top, said bucket being configured to receive paint and receive the bristle end of a paintbrush;

a bracket, mounting means on said bracket for detachable mounting on a paint pail and attachment means on said bracket for detachable attachment of said cutting bucket thereto;

a paintbrush holder on said bracket, said paintbrush holder having first and second fingers, said first and second fingers being resilient with respect to each other so that a paintbrush handle can be engaged therebetween to detachably hold a paintbrush so that its bristles extend into said cutting bucket and are away from said bottom of said cutting bucket so that the bristles are positioned in said cutting bucket to remain covered with paint and remain undistorted by contact with said walls and bottom of said cutting bucket, said fingers being mounted together on a base, said bracket being bifurcated to form left and right arms and said base being positioned between said arms, and a pivot pin engaging said arms and said base to pivotally mount said base with respect to said arms.

* * * * *